US006568577B2

(12) United States Patent
Baird et al.

(10) Patent No.: US 6,568,577 B2
(45) Date of Patent: May 27, 2003

(54) APPARATUS AND METHOD FOR SPLITTING MASONRY MATERIALS

(76) Inventors: Charles Baird, 173 Old Leechburg Rd., Pittsburgh, PA (US) 15239; Robert Baird, 173 Old Leechburg Rd., Pittsburgh, PA (US) 15239; Theodore Beatty, 173 Old Leechburg Rd., Pittsburgh, PA (US) 15239

( * ) Notice: Subject to any disclaimer, the term of this patent is extended or adjusted under 35 U.S.C. 154(b) by 0 days.

(21) Appl. No.: 09/863,953

(22) Filed: May 23, 2001

(65) Prior Publication Data

US 2002/0056738 A1 May 16, 2002

Related U.S. Application Data

(60) Provisional application No. 60/206,399, filed on May 23, 2000.

(51) Int. Cl.[7] ..... B26F 3/00
(52) U.S. Cl. ..... 225/103; 125/23.01
(58) Field of Search ..... 225/1, 103, 104, 225/105; 125/23.01, 35, 40

(56) References Cited

U.S. PATENT DOCUMENTS 2,572,537 A * 10/1951 Taylor ..... 225/103
2,657,681 A * 11/1953 Gatzke ..... 125/23.01
2,746,447 A * 5/1956 Petch ..... 125/23.01
2,779,324 A * 1/1957 Schlough et al. ..... 125/23.01
3,161,190 A * 12/1964 Stephens et al. ..... 125/23.01

OTHER PUBLICATIONS

"Electircl Hydraulic Splitter" from "Pave Tech Advanced Paving Technology" http://www.pavetech.com/newtools/Electrc_splitter.shtm.*

Pave Tech, www.pavetech.com/newtools/cutting.shtm.

* cited by examiner

*Primary Examiner*—Hwei-Siu Payer
(74) *Attorney, Agent, or Firm*—Buchanan Ingersoll, P.C.

(57) ABSTRACT

An apparatus for splitting solid and hollow masonry materials is provided. The apparatus includes changeable support tables and upper splitting blades to accommodate various types of masonry materials. A hydraulic ram is operated via a foot pedal to increase the pressure in the ram to raise a lower cutting blade and spring-loaded support table to exert upward and downward pressure on the material, coming it to clearly split. The upper blade is height-adjustable and the support table can be fixed in a lowered position to facilitate the splitting process by eliminating overly repetitive operation of the hydraulic ram.

30 Claims, 7 Drawing Sheets

APPARATUS AND METHOD FOR SPLITTING MASONRY MATERIALS

This patent application is closely related to our provisional patent application Ser. No. 60/206,399, filed on May 23, 2000.

BACKGROUND OF THE INVENTION

1. Field of the Invention

The invention relates to an apparatus for splitting bricks and blocks for landscaping and building construction purposes, and more particularly to an hydraulically operated apparatus capable of splitting solid bricks and hollow blocks.

2. Description of the Prior Art

The use of decorative and structural stones, blocks and bricks for building construction and landscaping is well known in the art. Many different types of bricks or precast concrete blocks can be used as decorative elements of a walkway or patio, or as structural elements in a retaining wall or for the facade of a building. These materials may also be used within the interior of a building such as a stone or brick fireplace or entryway. Generally speaking, such stones, bricks and blocks may broadly be referred to as masonry materials.

When fitting these masonry materials within the desired shape or form for their particular use, it is often necessary to cut or break portions of the material in order to fit the pieces in an aesthetically pleasing and structurally sound manner. In a landscaping situation for example, it is often necessary to form paving blocks around a curved section for a walkway or to fit blocks within a retaining wall such that the wall is structurally sound.

Many ways of cutting these masonry materials are well known in the art, from use of a hammer and a chisel, for example, to machinery which can accommodate larger bricks, on the order of 8 inches thick for example. On the upper end of these devices are hydraulically operated splitters in which a large blade or cutting element is brought into contact with a brick or other material to be cut, and pressure is applied to the masonry material through a hydraulically operated piston or ram. An example of such devices is the stone splitter or hydraulic stone cutter made by Pav Tech and Probst Tools. In both of these situations a portable device uses a hydraulic cylinder to provide pressure to an upper cutting blade which is brought downward into contact with the material causing the brick to break in two separate pieces. However, in both these situations the masonry material is permitted to fall to the sides of the devices, often crashing to the ground and chipping corners or edges of the bricks, thus making them unusable for their intended purposes. This results in not only wasted materials but also wasted time in having to split more bricks or blocks than are otherwise necessary. Moreover, for more brittle types of materials such as concrete paving blocks for example, it is often not desirable to use the hydraulic force to split the rock in that uneven edges can be formed, or the material may even shatter into more than two pieces. With such materials it is often better to apply pressure to "score" the material and then use a hammer blow to make the final cut to provide clean, sharp edges.

In addition, hollow materials are sometimes used in these circumstances. The prior devices discussed above are not suitable for splitting hollow masonry materials and a separate device, such as a stone cutter saw, is necessary. Thus, at a job where different types of materials are being used, different tools are needed in order to shape the bricks and blocks to fit the particular project being completed.

What is needed then is a device which can split various size paving bricks, blocks and stones, as well as one which can accommodate different masonry materials and either hollow or solid brick.

It is therefore an object of the present invention to provide a stone splitting device which can accommodate various masonry materials and shapes and sizes of paving and structural bricks and blocks.

SUMMARY OF THE INVENTION

An apparatus for splitting masonry materials, the apparatus comprising: a frame; an upper blade attached to the frame; a lower blade attached to the frame and positioned below the upper blade; a table for supporting masonry material attached to the frame adjacent to the lower blade, the table having a groove therein for passage of the lower blade there through; and means for raising the lower blade relative to the upper blade whereby masonry material supported on the table is split.

A method for splitting masonry material comprises the steps of providing an apparatus for supporting the masonry material, the apparatus including a table for supporting the masonry material thereon, a lower blade adapted to pass through a groove in the table, an upper blade attached to the apparatus above the lower blade and means for moving the lower blade with respect to the upper blade; measuring the masonry material to be split, setting a height of the upper blade according to the measurement placing the masonry material on the table, such that a portion of the masonry material to be split is positioned over the groove, setting said means for moving the lower blade to a raise position, and raising the lower blade into contact with the masonry material, whereby pressure is applied to the masonry material until the upper and lower blade cause the masonry material to split.

BRIEF DESCRIPTION OF THE DRAWINGS

Various other objects features an advantages of invention will become more apparent by reading the following detailed description in conjunction with the drawings, shown by way example only, wherein.

DESCRIPTION OF PREFERRED EMBODIMENTS

Figure 1:
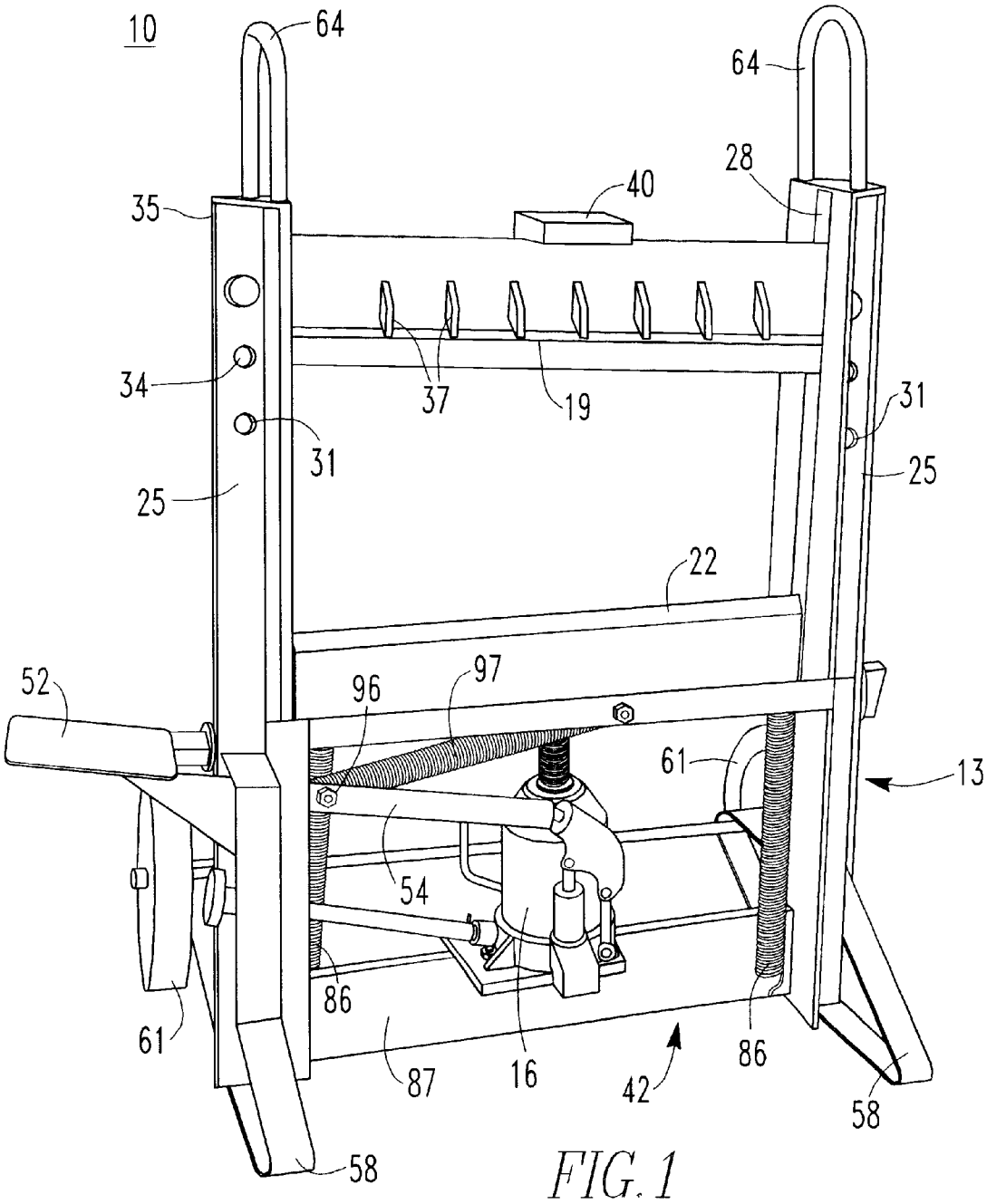
FIG. 1 is an elevational view of a preferred embodiment of a masonry material splitting apparatus according to the present invention.
Figure 2:
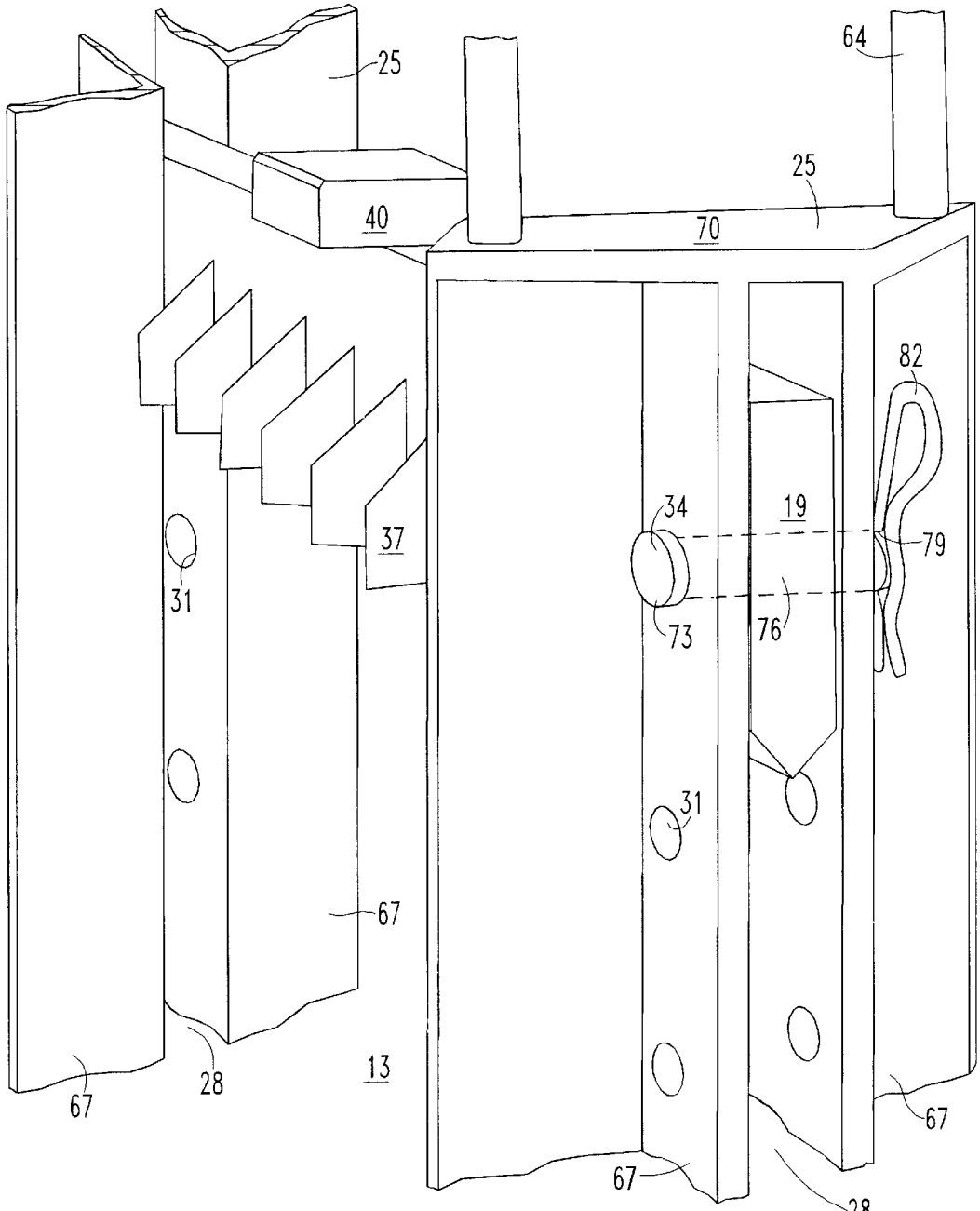
FIG. 2 is a detailed view of the top cutting blade and vertical supports according to a preferred embodiment of the present invention.
Figure 7:
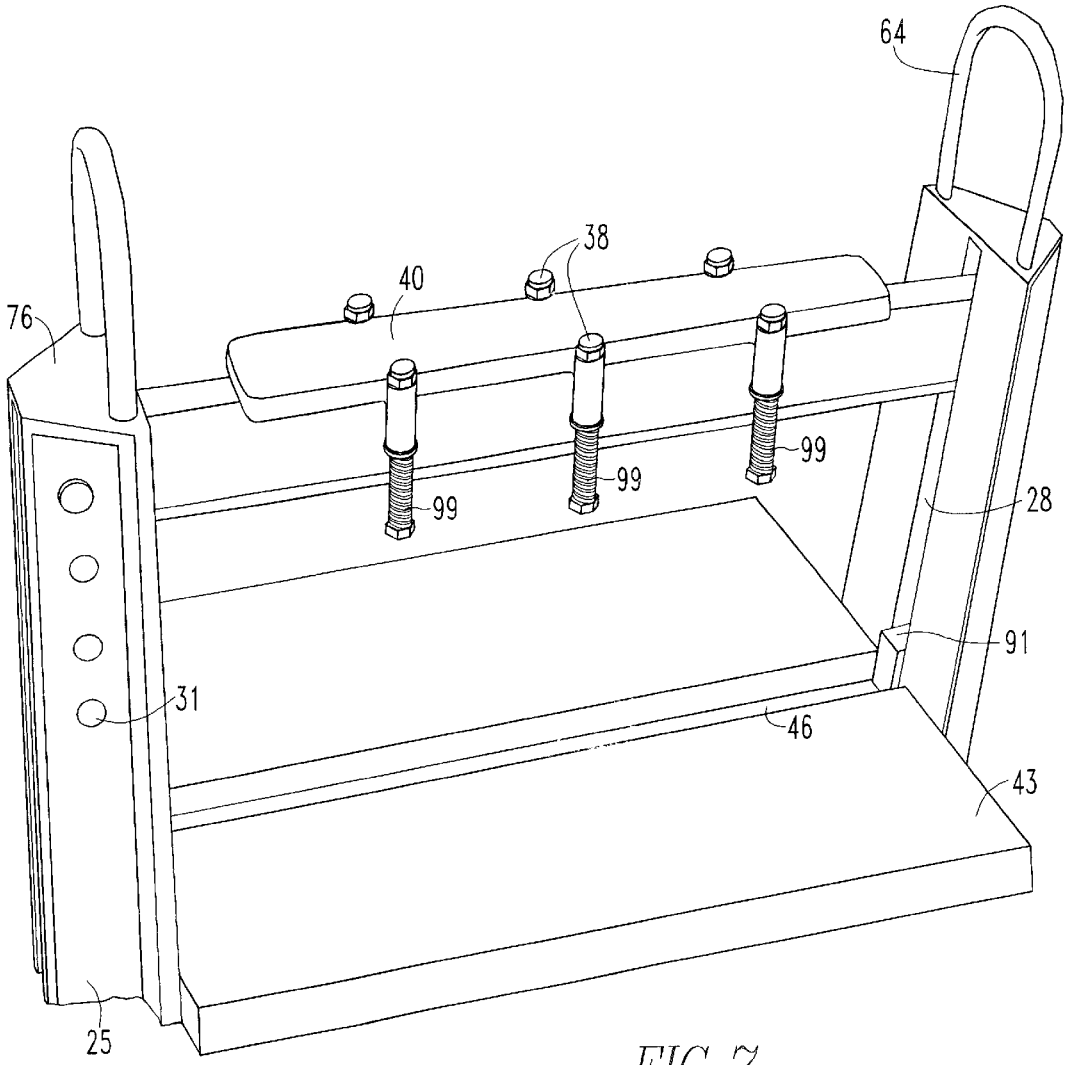
FIG. 7 is an elevational view of the splitting apparatus having an alternate top cutting blade.
Figure 8:
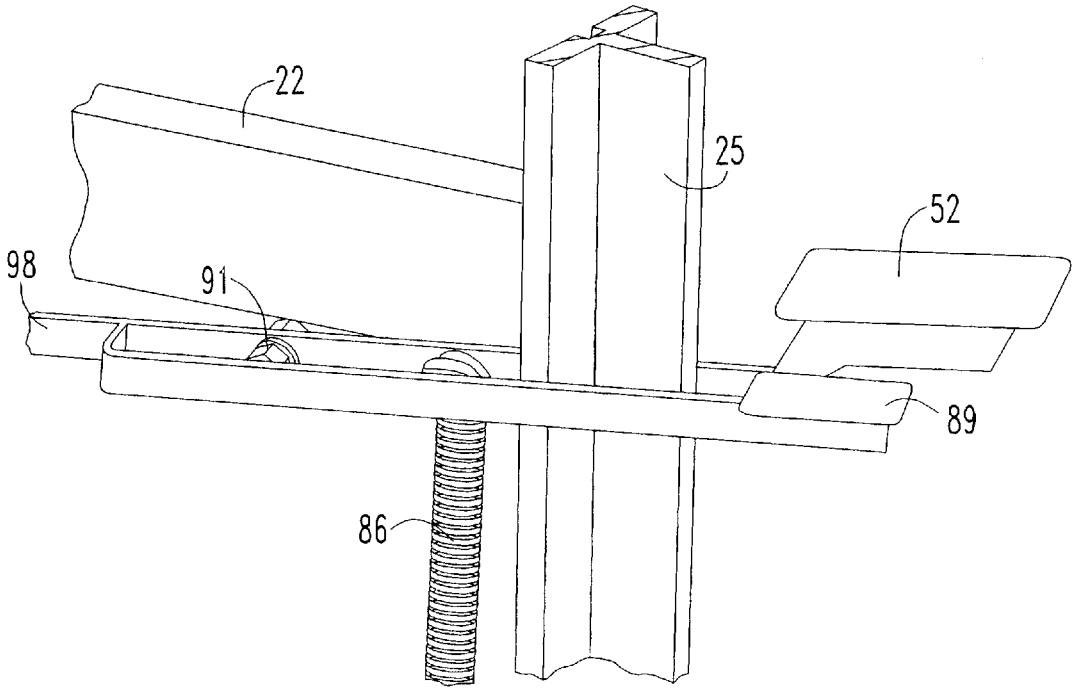
FIG. 8 is a detailed view of a foot pedal connection used to raise the hydraulic ram.

Referring now to the drawings in detail, FIG. 1 shows a front elevational view of a hydraulically operated masonry material splitting apparatus 10 according to the present invention. The device comprises a frame 13, to which are attached a hydraulic ram 16, and upper 19 and lower 22 cutting blades. The frame 13 comprises a pair of vertical supports 25, each comprising a pair of aligned steel members having a channel 28 therebetween and a series of aligned holes 31. As shown in FIG. 2, the holes accommodate pins 34 for securing the upper blade 19 at various heights along an upper portion 35 of the frame 13, as is described more fully hereinafter. It will be appreciated by those skilled in the art that other fastening members can be substituted for the pins 34, to attach the upper blade to the frame. Preferably the upper cutting blade 19 includes fingers 37 on either side thereof to capture a brick or block after it is cut and includes a striking platform 40, as will be discussed hereinafter. In the embodiment shown in FIG. 1, these fingers 37 are fixed with respect to the upper blade 19. In a most preferred embodiment shown in FIG. 7, the fingers 38 are spring-loaded with respect to the upper blade, as will be more fully described hereinafter.

Attached to a base portion 42 of the frame 13 is the lower blade 22 which has associated therewith a table 43 (FIG. 7) having a groove 46, through which the lower blade passes when cutting a brick or block. The groove 46 is preferably formed by joining or welding two individual pieces to construct the table 43. The size of the groove is preferably adjusted according to the type of masonry material being split, as is discussed below. Preferably the table 43 and lower cutting blade 22 are adjustable by means of a locking mechanism connected between the base 42 and the lower blade 22, as will be described more fully hereinafter. Preferably the piston 49 of the spring-loaded hydraulic ram 16 (FIG. 3) is operated by means of a foot pedal 52, but also may be operated by a hand operated crank (not shown), for raising the table 43 and lower blade 22 relative to the upper blade 19. The foot pedal 52 is operatively connected to an actuating lever 54 for the hydraulic ram 16 to raise the piston 49, and is movably attached (not shown) to one of the vertical supports 25 of the frame 13 by lever 56. Base portion 42 includes on opposite sides thereof support members 58, and wheels 61 for ease of portability. The hydraulic ram 16, lower blade 22 and support table 43 are attached to the frame 13 at the base 42. Preferably a pair of handles 64 are attached, one on each of the vertical supports 25, in order to easily transport the splitting apparatus 10 from one site to another or while at a particular work location. The operator need merely grab the handles 64 and then tilt splitting apparatus 10 to roll the device on its wheels 61, much like a dolly.

As shown in detail in FIG. 2, the vertical supports 25 each comprise a pair of structural steel support pieces 67 which are joined such as by upper and lower (the lower one is not shown) joint pieces 70 that are welded together to form a unitary vertical support structure forming the channel 28 therebetween. The handles 64 are then welded to the upper joint pieces 70. Holes 31 are provided within the vertical supports 25 at preselected locations, in order to accommodate different sized masonry materials such as at two and one-half inches, four inches, six inches and eight inches above the support table 43. It will be understood by those skilled in the art that more or less adjustment holes 31 may be provided, as well as at different height locations. The upper blade has corresponding openings (not shown) on either end thereof such that the blade is supported within the vertical support. Preferably pins 34 are also used having a larger diameter head 73 at one end to provide a stop against the vertical support 25 and a cylindrical portion 76 having a hole 79 therethrough at the opposite end to receive a hair pin 82, for example, to secure the pin 34 and thus the upper blade 19 within the vertical support 25. Alternatively, a bolt and nut arrangement (not shown) could be used to attach the upper blade 19 to the vertical supports 25.

Figure 3:
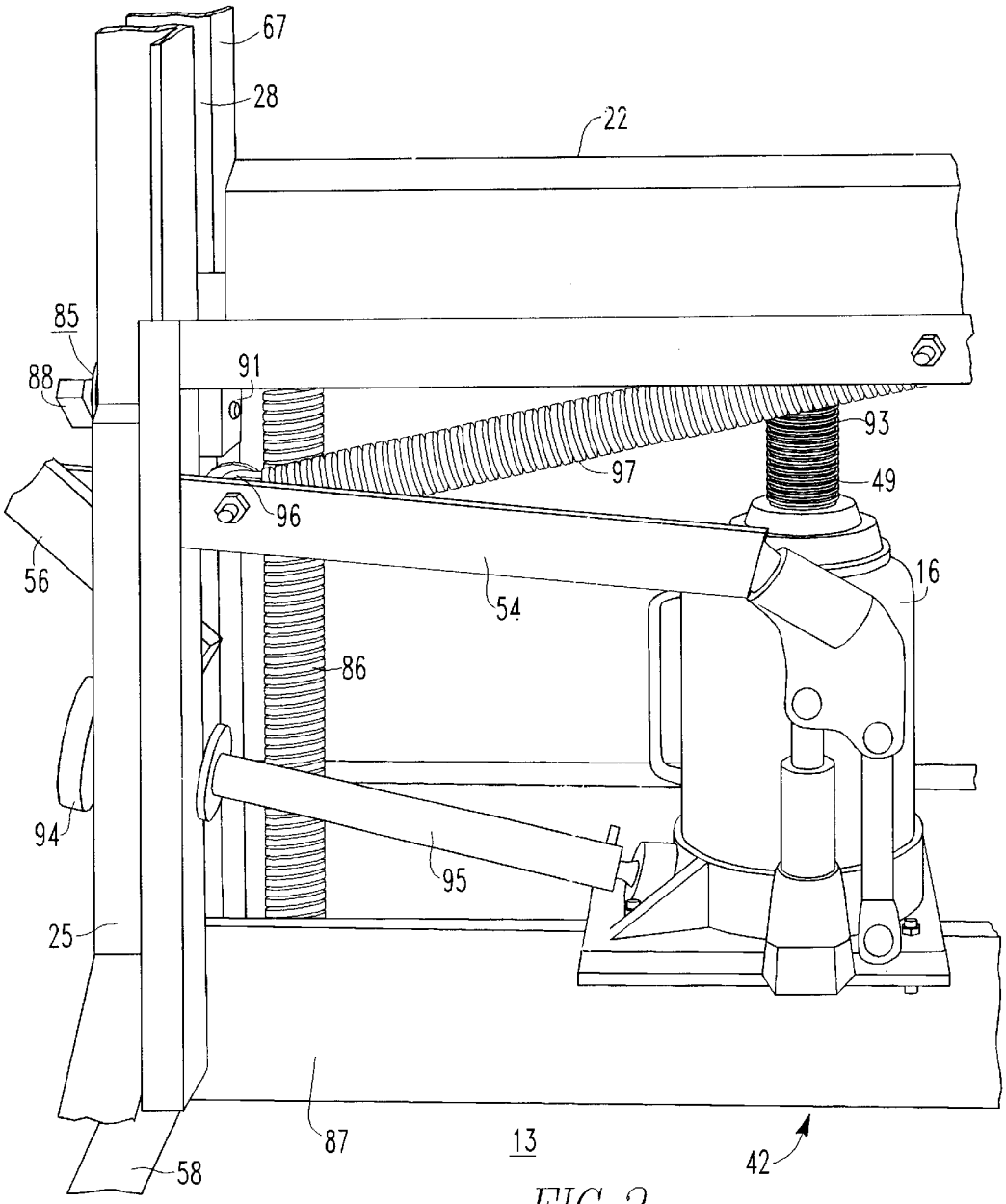
FIGS. 3 and 4 are detailed views of the spring-loaded hydraulic ram and lower table of the present invention.
Figure 4:
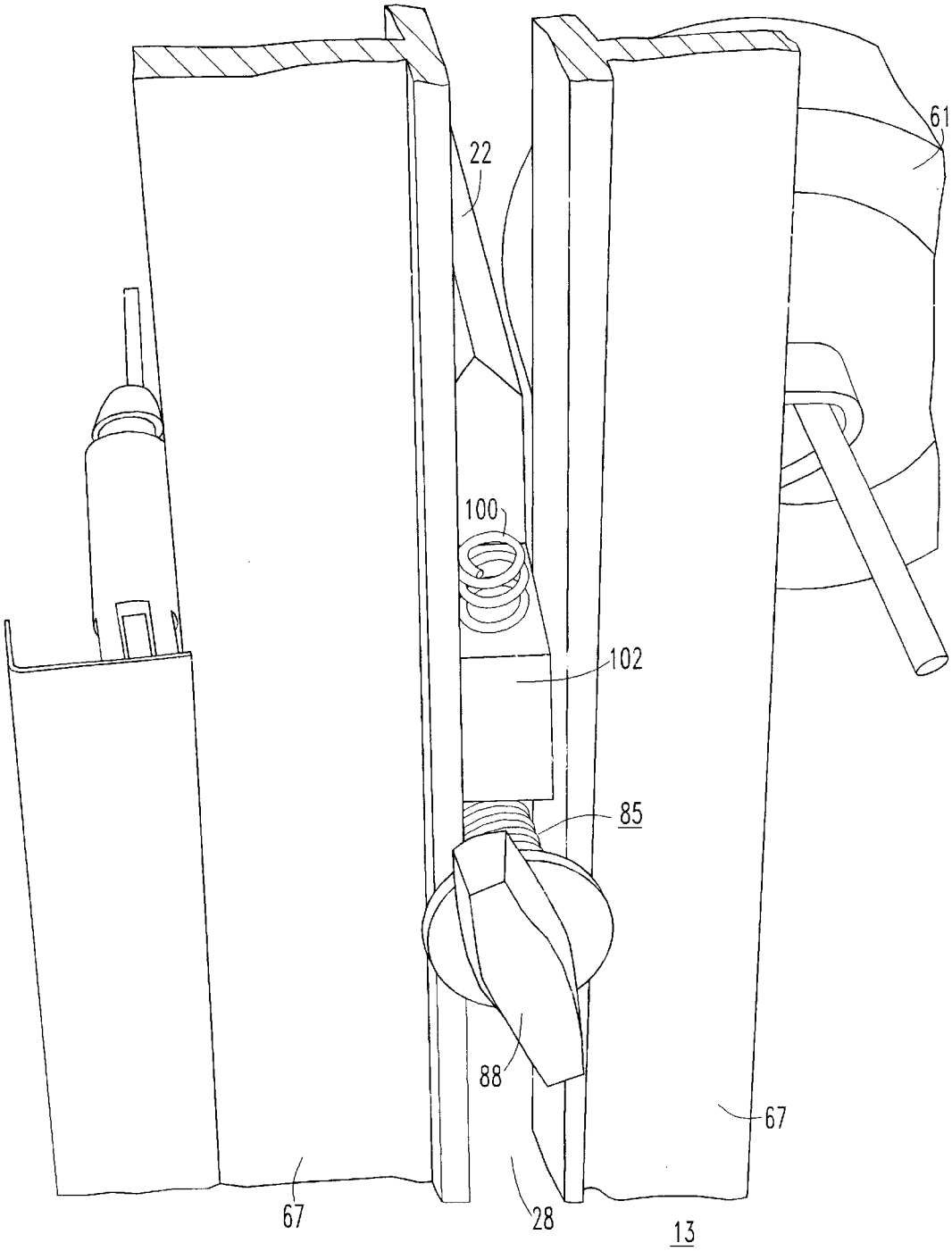

As shown in FIGS. 3 and 4, to facilitate the splitting process and to accommodate non-uniform sized bricks or blocks, the device includes a spring loaded adjustment mechanism 85 for raising and lowering the support table 43. A pair of first, generally vertical springs 86 are attached between the bottom of the lower blade 22 on either side thereof and a bottom portion 87 of the frame 13. These springs 86 are preferably tension springs which provide a downward force or pull on the lower blade 22. In a first embodiment after the hydraulic ram foot pedal 52 is used to raise the piston 49, and then the lower blade 22, until a minimal clearance, preferably about ⅛ inch, is provided between the upper blade 19 and the masonry material to be split, the adjustment knobs 88 (one on each side of the lower blade) are loosened. This releases the pressure on the stop blocks 91, which can then slide within the channel 28 between the vertical support pieces 67. After the stop blocks are at the desired height contacting the under side of the lower blade 22, the adjustment knobs 88 are tightened to lock the stop blocks 91, lower blade 22 and support table 43 at the desire height. This enables quick change-out of split masonry material and insertion of the next block or brick to be split, as described more fully hereinafter.

In the best mode of the invention presently contemplated by the inventors, the lower blade 22 is "locked" into position by a second, locking foot pedal 89 which is pivotally connected 92 to the frame 13 adjacent a top portion 93 of the hydraulic ram piston 49. Hydraulic pressure is applied and released on the hydraulic ram 16 by valve positioner knob 94, which is connected to the hydraulic ram 16 by a rod 95 in a manner well known in the art. In addition the foot pedal 52 and ram actuating lever 54 is pivotally connected 96 to the frame 13 by a third tension spring 97 which is adapted to automatically raise the foot pedal 52 after the operator steps downward on it in order to operate the hydraulic ram 16.

In order to split the structural bricks or paving blocks using the apparatus of the present invention, the following steps are preferably performed. After the width of the material is measured, the top blade 19 is adjusted to the proper setting utilizing the holes 31 and pins 34 as discussed above. The device is adjusted, such as for masonry material being four inches thick, by pinning the upper blade in the lower hole 31 a in the vertical support 25 according to the embodiment discussed herein. Preferably this provides a nominal gap between the top of the masonry material and the top blade 19. The masonry material is then placed on the table 43 between the upper 19 and lower 22 cutting blades. The hydraulic ram 16 is placed in the raised position and the lower blade 22 and support table 43 are raised by pumping the hydraulic ram 16 via the foot pedal 52 until a nominal minimum clearance is provided between the masonry material and the upper blade 19. Generally, these steps need only be performed for the first block or brick to be split, as an operator will typically be working with the same type of material for a particular job over an extended period. However, in the case of non-uniform masonry materials, the vertical adjustment of the lower blade 22 by the hydraulic ram 16 and the foot pedal 52 minimize the effort needed to adjust the table 43 for these types of materials. The material to be cut preferably is aligned under the center portion of the top blade. The valve positioner knob 94 for the hydraulic ram 16 is turned clockwise to the raise position and the table is raised by activating the foot pedal until the desired clearanced is reached between the upper blade 19 and the material to be split. The operator then lowers locking foot pedal 89 so that the opposite end 98 is caused to move upward by means of the pivotal connection 91. The opposite end 98 contacts the underneath of the support table 43, thereby raising the table and masonry material 121 upward such that the masonry material is locked into position between the support table 43 and the upper blade 19. At this point the hydraulic ram 16 is operated via the foot pedal 52 such that the lower blade 19 is moved upwards until contact is made with the bottom of the masonry material 121, and the operator continues to pump the foot pedal 52 to raise the hydraulic piston 49 until the masonry material is split.

When the material is split, the two pieces are generally forced horizontally outward, away from the upper 19 and lower 22 blades. The spring loaded fingers 38 (FIG. 7) on the upper blade help to capture the two halves of the material and prevent pieces from flying away from the device 10. The springs 99 on the fingers 38 relieve the upward pressure on the support table 43 at the moment the masonry material is split, as the table tends to "jump" upwards since the downward pressure on the hydraulic piston 49 is suddenly released. After the material is split, the valve positioner 94 on the hydraulic ram 16 is rotated counter-clockwise to the lowering position and the spring tension 86 causes the lower blade and table to be pulled downward. After the split masonry material is removed, the next one is placed on the support table the hydraulic ram placed in the raising position and the process repeated. By way of the stop blocks 91, the support table 43 is pulled downward only until the lower blade 22 contacts the blocks 91, and the valve positioner 94 is tightened to the raise position for splitting the next piece. Because a contractor will typically be working on the same masonry material over a period of time, this provides for quicker change-out and set up for successive blocks since the table and lower blades are prevented from being pulled downward completely by the stop blocks 91. In this manner, the table 43 does not have to be raised the full length of vertical travel to bring the next piece of masonry material into contact with the upper blade.

To aid in splitting the masonry material, the support table is also spring loaded with respect to the lower blade. As shown in FIG. 4, table springs 100 are attached to an upper portion 102 of the lower blade 22, one on each end which slides within the channels 28. The support table 43 is placed on these ends of the lower blade which is thereby positioned adjacent the table groove 46. After the masonry material is placed on the table, the hydraulic ram is operated to raise the table and the material is brought into contact with the upper blade. At this point, the downward pressure exerted by the upper blade on the top surface of the masonry material compresses the table springs 100 and prevents the support table 43 from moving further while the lower blade 22 continues to move upward through the table groove 46 and into contact with lower surface of the masonry material. As the operator continues to use the foot pedal 52 to increase the hydraulic pressure, the lower 22 and upper 19 blades transmit this pressure to the material until it is scored and ultimately split. Simultaneously with the splitting of the masonry material, the downward pressure on the support table 43 is released, causing the table 43 to spring upward, capturing the two halves of the material between the table 43 and the fingers 37, 38 on the upper blade 39, preventing them from inadvertently sliding off the support table. The table springs 100 and finger springs 99 absorb the sudden pressure exerted on the table 43.

Figure 5:
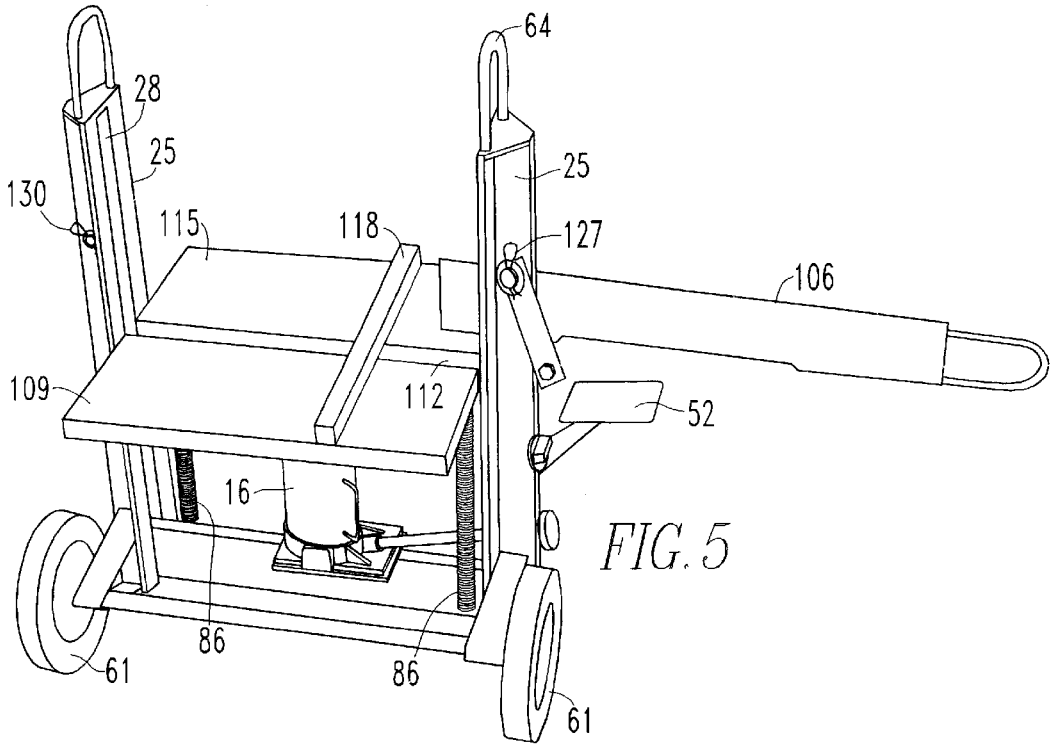
FIGS. 5 and 6 are elevational views of the apparatus for splitting hollow masonry materials.

Although the table springs 100 are shown as attached to the lower blade 22, in a most preferred embodiment they are attached to the bottom side of the support table 43. It has been determined that it is desirable to use table springs having a relatively lower spring force when splitting hollow masonry materials than that used for solid blocks or bricks. Also, as shown in FIG. 5, the table groove 112 for hollow materials, such as a concrete block, is somewhat larger since hollow materials tend to have larger pieces which break off from the material as it is split and the larger groove allows these to easily pass between the halves of the table and the lower blade. Thus, when the table springs 100 are attached to bottom side of the support table 43, the different types of tables will also have the preferred type of spring between it and the lower blade.

Alternatively, for relatively brittle materials or those requiring a cleaner cut, the foot pedal 52 is pumped until sufficient pressure is provided by the upper 19 and lower 22 blades to score the material. The operator then takes a sledge hammer or the like and hits the striking platform 40 on the upper blade 19 in order to provide the final clean cut for the masonry material. This is not possible with prior art stone splitters since the hydraulic piston is on the upper blade of these devices. By means of the lower table 43 and the fingers 37, 38 on the upper blade 19, the split material is merely pushed to the side of the upper blade and remains on the table and does not fall to the ground as with prior art devices, thus preventing inadvertent chipping of the two halves of the split material.

Figure 6:
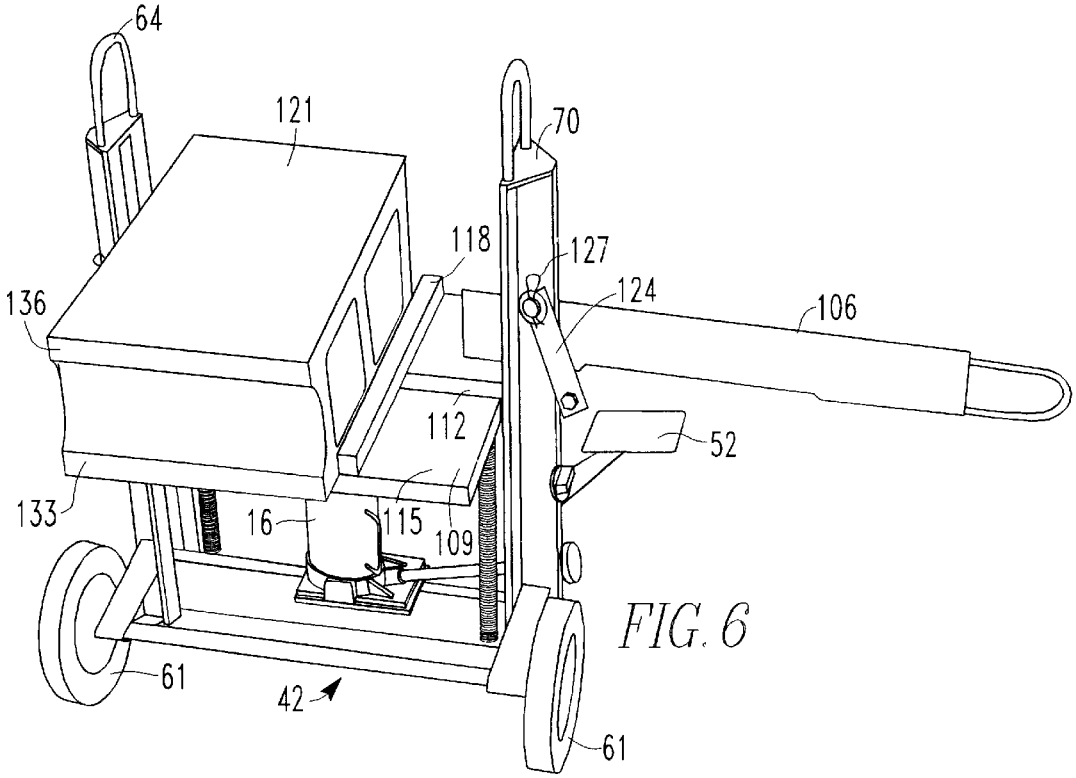

In order to split hollow masonry materials the upper blade 19 is removed and a hollow material upper splitting blade 106 is used, as shown in FIGS. 5 and 6. As stated previously, a hollow material support table 109 is used. In addition to having a wider table groove 112 and lower force table springs (not shown), the upper surface 115 of the hollow material support table 109 also includes a guide bar 118. Preferably, the guide bar has dimensional markings (not shown), having a zero center-point and equal length dimension on either side thereof. This assists the operator in centering the hollow material and splitting to the desired length.

As shown in FIG. 6, a concrete block, for example, is placed on the table 109, and the hollow material splitting blade 106 secured in place. A blade support mechanism 124 is pinned 127 to one of the vertical supports, preferably in the same manner as the solid material upper blade is. A second pin 130 is provided in the other vertical support, both of which act as an upper stop for the hollow material upper blade 106. When the hollow masonry material concrete block is in the desired position, the hollow material blade 106 is positioned through the blade support mechanism on the first vertical support and slid through the channel 28, the concrete block and into the channel of the other vertical support 25. The hollow material support table 109 is raised and a first side 133 of the hollow block split. After the support table 109 is lowered, the blade 106 is pulled back through the channel and the concrete block rotated 1800 to split the second side 136 of the hollow masonry material. Except as explained above, the operation of the spring loaded hydraulic ram and support table is substantially similar to that for the solid masonry material.

While specific embodiments from the invention have been described in detail, it would be appreciated by those skilled in the art that there is modification and alterations would be developed in light of the overall teachings of the disclosure. Accordingly, the particular arrangements disclosed are meant to be illustrative only and not limiting as to the scope of the invention which is if you gave them the full breadth of the appended claims and in any and all equivalents thereof.

We claim:

1. An apparatus for splitting masonry material, the apparatus comprising:

a frame;

an upper blade attached to the frame;

a lower blade attached to the frame by at least one tensioning spring secured between a bottom portion of the lower blade and a lower portion of the frame, the lower blade being positioned below the upper blade;

a table for supporting masonry material operatively associated with the lower blade, the table having a groove therein for passage of the lower blade there through;

a hydraulic ram supported on the lower portion of the frame;

a locking pedal pivotally secured to the lower portion of the frame adjacent the table, wherein one end of the locking pedal contacts the bottom of the table as the other end is pivoted downward such that the table is locked into position relative to the upper blade and the lower blade; and a foot pedal connected to an actuating lever for the hydraulic ram and the actuating lever is pivotally connected to the lower portion of the frame such that downward pressure on the foot pedal causes a piston of the hydraulic ram to be moved upward, such that the piston is operable to raise the lower blade relative to the upper blade whereby masonry material supported on the table is split.

2. The apparatus as recited in claim 1, wherein the frame comprises a pair of vertical supports, each of said supports having a vertical channel therein such that either end of the upper blade is attached to each of the vertical supports within the vertical channels.

3. The apparatus as recited in claim 2, further comprising a pair of stop blocks removably received to a respective one of said vertical supports adjacent the lower blade and for supporting said lower blade to the frame.

4. The apparatus as recited in claim 3, wherein said hydraulic ram is supported on a lower portion of the frame.

5. The apparatus as recited in claim 1, wherein the upper blade includes one or more fingers on at least one side thereof for capturing the masonry material between the table and the upper blade.

6. The apparatus as recited in claim 5, wherein said fingers further comprise an upper portion secured to the upper blade and a tensioning member operatively associated thereto, such that the tensioning member projects downward from the upper blade.

7. The apparatus as recited in claim 1, wherein the frame further includes a pair of wheels attached to a lower portion thereof for transporting the apparatus.

8. The apparatus as recited in claim 2, wherein each of the vertical supports includes at least one hole therethrough and the upper blade has corresponding openings on either end thereof such that the upper blade is attached to the frame by a pair of fastening members inserted through said at least one hole and said openings.

9. An apparatus for splitting masonry material, the apparatus comprising:

a frame;

an upper blade attached to the frame;

a lower blade attached to the frame and positioned below the upper blade;

a table for supporting masonry material operatively associated with the lower blade, the table having a groove therein for passage of the lower blade there through;

a hydraulic ram supported on a lower portion of the frame; and a foot pedal connected to an actuating lever for the hydraulic ram such that downward pressure on the foot pedal causes a piston of the hydraulic ram to be moved upward, and the piston is operable to raise the lower blade relative to the upper blade whereby masonry material supported on the table is split, and wherein the actuating lever is pivotally connected to the lower portion of the frame with a tension spring such that the foot pedal is automatically brought to a raised position after being moved downward.

10. The apparatus as recited in claim 9, wherein the frame comprises a pair of vertical supports, each of said supports having a vertical channel therein such that either end of the upper blade is attached to each of the vertical supports within the vertical channels.

11. The apparatus as recited in claim 10, further comprising a pair of stop blocks removably received to a respective one of said Vertical supports adjacent the lower blade and for supporting said lower blade to the frame.

12. The apparatus as recited in claim 11, wherein said hydraulic ram is supported on a lower portion of the frame.

13. The apparatus as recited in claim 9, wherein the frame further includes a pair of wheels attached to a lower portion thereof for transporting the apparatus.

14. The apparatus as recited in claim 10, wherein each of the vertical supports includes at least one hole therethrough and the upper blade has corresponding openings on either end thereof such that the upper blade is attached to the frame by a pair of fastening members inserted through said at least one hole and said openings.

15. The apparatus as recited in claim 9, further comprising at least one tensioning spring secured between a bottom portion of the lower blade and the lower portion of the frame.

16. The apparatus as recited in claim 15, further comprising a locking pedal pivotally secured to the lower portion of the frame adjacent the table, wherein one end of the locking pedal contacts the bottom of the table as the other is pivoted downward such that the table is locked into position relative to the upper blade and the lower blade.

17. The apparatus as recited in claim 16, wherein the upper blade includes one or more fingers on at least one side thereof for capturing the masonry material between the table and the upper blade.

18. The apparatus as recited in claim 17, wherein said fingers further comprise an upper portion secured to the upper blade and a tensioning member operatively associated thereto, such that the tensioning member projects downward from the upper blade.

19. An apparatus for splitting masonry materials, the apparatus comprising:

a frame comprising a pair of vertical supports, each of said supports having a vertical channel therein;

an upper blade attached to the frame, such that either end of the upper blade is attached to each of the vertical supports within the vertical channels;

a lower blade attached to the frame and positioned below the upper blade;

a table for supporting masonry material operatively associated with the lower blade, the table having a groove therein for passage of the lower blade there through; and means for raising the lower blade relative to the upper blade whereby masonry material supported on the table is split.

20. The apparatus as recited in claim 19, wherein said raising means comprises a hydraulic ram supported on a lower portion of the frame such that a piston of the hydraulic ram is operable to raise the lower blade.

21. The apparatus as recited in claim 20, wherein the hydraulic ram has a foot pedal connected to an actuating lever of the hydraulic ram, and the actuating lever is pivotally connected to the lower portion of the frame whereby downward pressure on the foot pedal causes the piston to be moved upward.

22. The apparatus as recited in claim 21, wherein the actuating lever is pivotally connected to the lower portion of the frame with a tension spring such that the foot pedal is automatically brought to a raised position after being moved downward.

23. The apparatus as recited in claim 21, further comprising at least one tensioning spring secured between a bottom portion of the lower blade and the lower portion of the frame.

24. The apparatus as recited in claim 23, further comprising a locking pedal pivotally secured to the lower portion of the frame adjacent the table, wherein one end of the locking pedal contacts the bottom of the table as the other is pivoted downward such that the table is locked into position relative to the upper blade and the lower blade.

25. The apparatus as recited in claim 24, wherein the upper blade includes one or more fingers on at least one side thereof for capturing the masonry material between the table and the upper blade.

26. The apparatus as recited in claim 25, wherein said fingers further comprise an upper portion secured to the upper blade and a tensioning member operatively associated thereto, such that the tensioning member projects downward from the upper blade.

27. The apparatus as recited in claim 19, further comprising a pair of stop blocks removably received to a respective one of said vertical supports adjacent the lower blade and for supporting said lower blade to the frame.

28. The apparatus as recited in claim 27, wherein said raising means comprises a hydraulic ram supported on a lower portion of the frame such that a piston of the hydraulic ram is operable to raise the lower blade.

29. The apparatus as recited in claim 19, wherein the frame further includes a pair of wheels attached to a lower portion thereof for transporting the apparatus.

30. The apparatus as recited in claim 19, wherein each of the vertical supports includes at least one hole therethrough and the upper blade has corresponding openings on either end thereof such that the upper blade is attached to the frame by a pair of fastening members inserted through said at least one hole and said openings.

* * * * *